US007121817B2

(12) United States Patent
Yanagisawa et al.

(10) Patent No.: US 7,121,817 B2
(45) Date of Patent: Oct. 17, 2006

(54) SCROLL FLUID MACHINE COMPRISING COMPRESSING AND EXPANDING SECTIONS

(75) Inventors: Ken Yanagisawa, Yokohama (JP); Tamotsu Fujioka, Yokohama (JP)

(73) Assignee: Anest Iwata Corporation, (JP)

( * ) Notice: Subject to any disclaimer, the term of this patent is extended or adjusted under 35 U.S.C. 154(b) by 20 days.

(21) Appl. No.: 10/939,745

(22) Filed: Sep. 13, 2004

(65) Prior Publication Data

US 2005/0031469 A1 Feb. 10, 2005

(51) Int. Cl.
*F03C 2/00* (2006.01)
*F04C 18/00* (2006.01)

(52) U.S. Cl. ..... 418/60; 418/55.1; 418/55.2; 418/101; 418/209

(58) Field of Classification Search ..... 418/55.1, 418/55.2, 58, 60, 61.1, 101, 188, 209
See application file for complete search history.

(56) References Cited

U.S. PATENT DOCUMENTS

| | | | | |
|---|---|---|---|---|
| 5,690,480 | A * | 11/1997 | Suzuki et al. | 418/55.2 |
| 6,109,897 | A * | 8/2000 | Haga | 418/55.1 |
| 6,338,912 | B1 * | 1/2002 | Ban et al. | 429/34 |
| 6,506,512 | B1 | 1/2003 | Mori et al. | |
| 7,014,434 | B1 * | 3/2006 | Fujioka et al. | 418/55.1 |
| 7,014,435 | B1 * | 3/2006 | Yanagisawa et al. | 418/55.2 |

* cited by examiner

*Primary Examiner*—Theresa Trieu

(57) ABSTRACT

A scroll fluid machine comprises an orbiting scroll and front and rear stationary scrolls. The orbiting scroll is driven by a driving shaft via an eccentric portion and has front and rear orbiting scroll wraps. The front and rear stationary scroll have front and rear orbiting scroll wraps respectively. The orbiting scroll is revolved by the driving shaft with respect to the stationary scrolls while the front and rear orbiting scroll wraps are engaged with the front and rear stationary scroll wraps to create front compressing and rear expanding sections. Fluid expanded and cooled in the expanding section is used for cooling parts of the machine.

9 Claims, 9 Drawing Sheets

SCROLL FLUID MACHINE COMPRISING COMPRESSING AND EXPANDING SECTIONS

BACKGROUND OF THE INVENTION

The present invention relates to a scroll fluid machine comprising compressing and expanding sections and especially to a scroll fluid machine used to feed air into and discharge it from a fuel cell.

In a fuel cell, there is electrolyte between an anode and a cathode, and hydrogen is fed as cathode active material to the cathode. Hydrogen from which electrons are taken away at the cathode becomes hydrogen ions which move to the anode through the electrolyte. Oxygen is fed as anode active material to the anode and receives electrons from the cathode through an external circuit to allow the hydrogen ions to react with oxygen to form water. Hence electrons flow from the cathode to the anode or an electric current flows from the anode to the cathode. Generally oxygen-containing air is fed to the anode, so that unreactive oxygen and nitrogen as main component of air exist on the anode in addition to water.

Combination of hydrogen and oxygen is exothermic reaction and its temperature rises from supplied air. The gas which contains nitrogen as main component should be discharged from the anode.

Air pressurized by a compressor is fed to the anode, and the gas at the anode has higher pressure than atmospheric pressure. If the gas is released to air, it will become loss without doing work. Energy of the gas is retrieved through an expander. Thus, the fuel cell may preferably have a compressor and an expander.

U.S. Pat. No. 6,506,512 BI to Mon et al. discloses a compression regenerative machine for a fuel cell as fluid machine having a compressor and an expander. The scroll fluid machine has an orbiting scroll each side of which has a scroll wrap, one scroll wrap compressing sucked fluid, while the other expands sucked fluid to do work.

In the compression regenerating machine, fluid expanded and fallen in temperature in an expanding section cools an orbiting scroll from the expanding section, and fluid is expanded from the center to the circumference. However, there is no expanded or cooled fluid at the center, and no consideration is paid on cooling a bearing for an eccentric pin, a journal bearing for a driving shaft at the center of the orbiting scroll or an electric motor for driving a driving shaft.

Thus, in a small space such as an automobile engine room isolated from outside, surrounding temperature rises to lead poor heat radiation for a long time operation to raise temperature of the bearing thereby decreasing it life. Thermal expansion results in contacting the stationary scroll with the orbiting scroll to damage them. The electric motor heated during rotation for the driving shaft decreases its life.

In view of the foregoing disadvantages, it is an object to provide a scroll fluid machine having a compressing section and an expanding section at both sides of an orbiting scroll end plate, fluid which is fallen in temperature with expansion in the expanding section being applied to cool an orbiting scroll, a bearing or a driving machine effectively.

The foregoing and other features and advantages of the invention will become more apparent from the following description with respect to embodiments as shown in appended drawings.

SUMMARY OF THE INVENTION

The present invention is a scroll fluid machine having a driving shaft with an eccentric portion at one end, an orbiting scroll with an orbiting end plate that has front and rear scroll wraps, a front stationary scroll comprising a front stationary end plate with a front stationary wrap, and a rear stationary scroll having a rear stationary end plate with a rear stationary wrap. An electric motor drives the drive shaft behind the rear stationary end plate. The orbiting scroll is driven by the drive shaft and revolves with respect to the front and rear stationary scrolls to create front compressing and rear expanding sections while the front and rear orbiting scroll wraps are engaged with the front and rear stationary scroll wraps respectively. Fluid expanded and cooled in the expanding section is used to partially cool the scroll fluid machine.

DETAILED DESCRIPTION OF PREFERRED EMBODIMENTS

Figure 1:
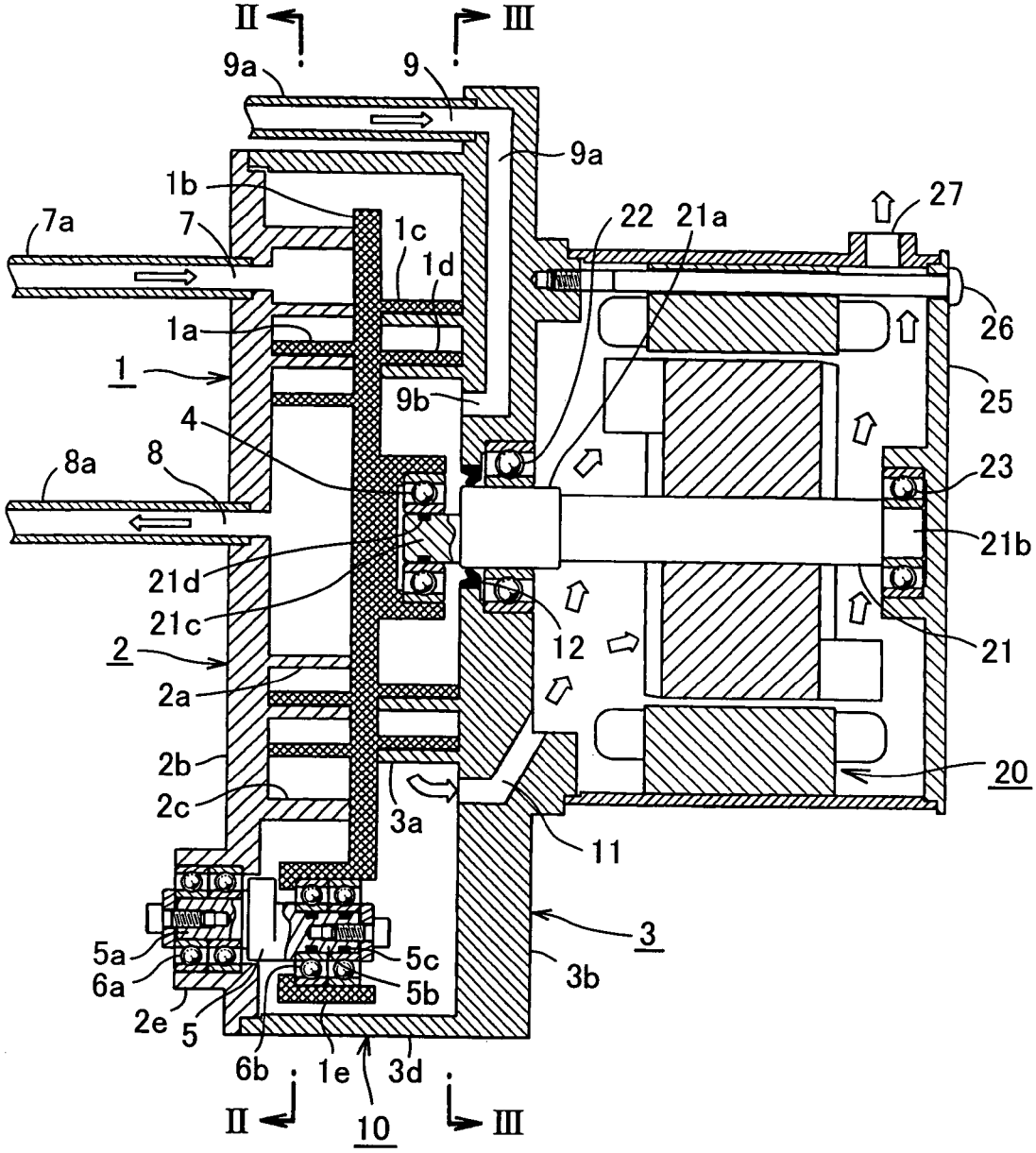
FIG. 1 is a vertical sectional view of the first embodiment of a scroll fluid machine according to the present invention.

FIG. 1 illustrates one embodiment of a scroll fluid machine according to the present invention, comprising a scroll portion 10 and an electric motor 20. A front orbiting scroll wrap 1*a* and a rear orbiting scroll wrap 1*c* are provided on both sides of an orbiting end plate 1*b* of an orbiting scroll 1. On a stationary end plate 2*b* of a front stationary scroll 2, there are provided a front stationary scroll wrap 2*a* engaged with the front orbiting scroll wrap 1*a*, and an annular partition wall 2*c*. The rear stationary scroll 3 has an outer peripheral wall 3*d* and a stationary end plate 3*b* on which a rear stationary scroll wrap 3*a* engaged with the rear orbiting scroll wrap 1*c* is provided. The outer peripheral wall 3*d* is fixed to the stationary end plate 2*b* of the front stationary scroll 2. The front stationary and orbiting scroll wraps 2*a*, 1*a* constitute a compressing section, and the rear stationary and orbiting scroll wraps 3*a*, 1*c* constitute an expanding section. The compressing and expanding sections are partitioned by the annular partition wall 2*c* of the front stationary scroll end plate 2*b*.

An electric motor 20 is fixed to the rear stationary scroll end plate 3*b* by a bolt 26. A driving shaft 21 of the electric motor 20 is supported at journals 21*a*, 21*b* by rear stationary scroll end plate 3*b* and a rear cover 25 via bearings 22, 23.

A seal 12 seals the electric motor at the center of the compressing section of the scroll portion.

An eccentric portion 21*c* at the front end of the driving shaft 21 is supported by a bearing 4 in a boss 1*d* at the center of the rear surface of the orbiting scroll.

At the outer circumference of the orbiting scroll 1, three bosses 1*e* are projected at three vertexes of an equilateral triangle. An eccentric pin 5*b* of an auxiliary crank 5 is supported by the boss 1*e* via a bearing 6*b*. A journal 5*a* of the auxiliary crank 5 is rotatably supported via a bearing 6*a* by a boss 2*e* on the outer circumference of the front stationary scroll end plate. These prevent the orbiting scroll from rotating on its own axis.

Eccentricity of the driving shaft 21 with respect to an axis of the eccentric portion 21*c* is equal to that of the auxiliary crank eccentric pin 5*b* with respect to an axis of the journal 5*a*. Thus, when the driving shaft 21 rotates, the orbiting scroll 1 revolves around the axis of the driving shaft 21. The revolving mechanism may be a known Oldham coupling.

Numerals 21*d*, 5*c* are elastic rings. When an inner ball of the bearing is loosened from the eccentric pin so as to enable the bearing 4 of the orbiting scroll to insert into the eccentric portion 21*c*, the elastic ring 21*d* prevents corrosion owing to rotation of the inner ball to the pin. For example, when an elastic ring such as rigid rubber is fitted in a groove of the eccentric pin, the elastic material reduces resistance during fitting of the inner ball, but its friction prevents the inner ball from rotating on the eccentric pin.

The elastic ring 28 enables the eccentric pin 5*b* of the auxiliary crank 5 to insert into the bearing 6*b* of the orbiting scroll 1 and prevents the inner ball of the bearing 6*a* from sliding.

Figure 2:
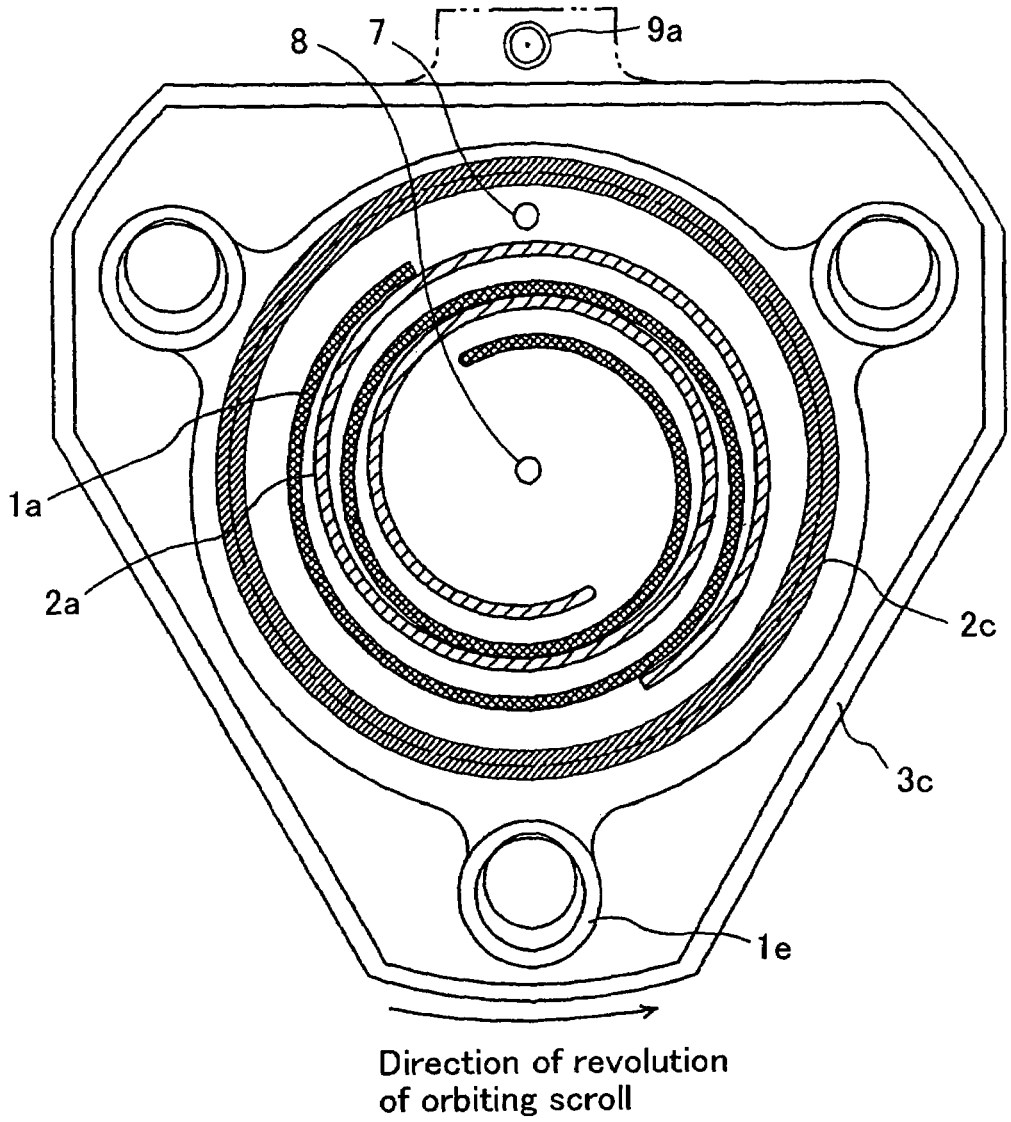
FIG. 2 is a vertical sectional view taken along the line II–II in FIG. 1, removing an auxiliary crank shaft and a bearing therefor.

In FIG. 2, an inlet 7 of the compressing section is formed on the stationary end plate 2*b* of the front stationary scroll 2 between the annular partition wall 2*c* and the outer circumference of the scroll wrap, and an outlet 8 is formed at the center, and pipes 7*a* and 8*a* are connected thereto. Fluid sucked into the inlet 7 is compressed towards the center by revolution of the orbiting scroll and discharged from the outlet 8.

Figure 3:
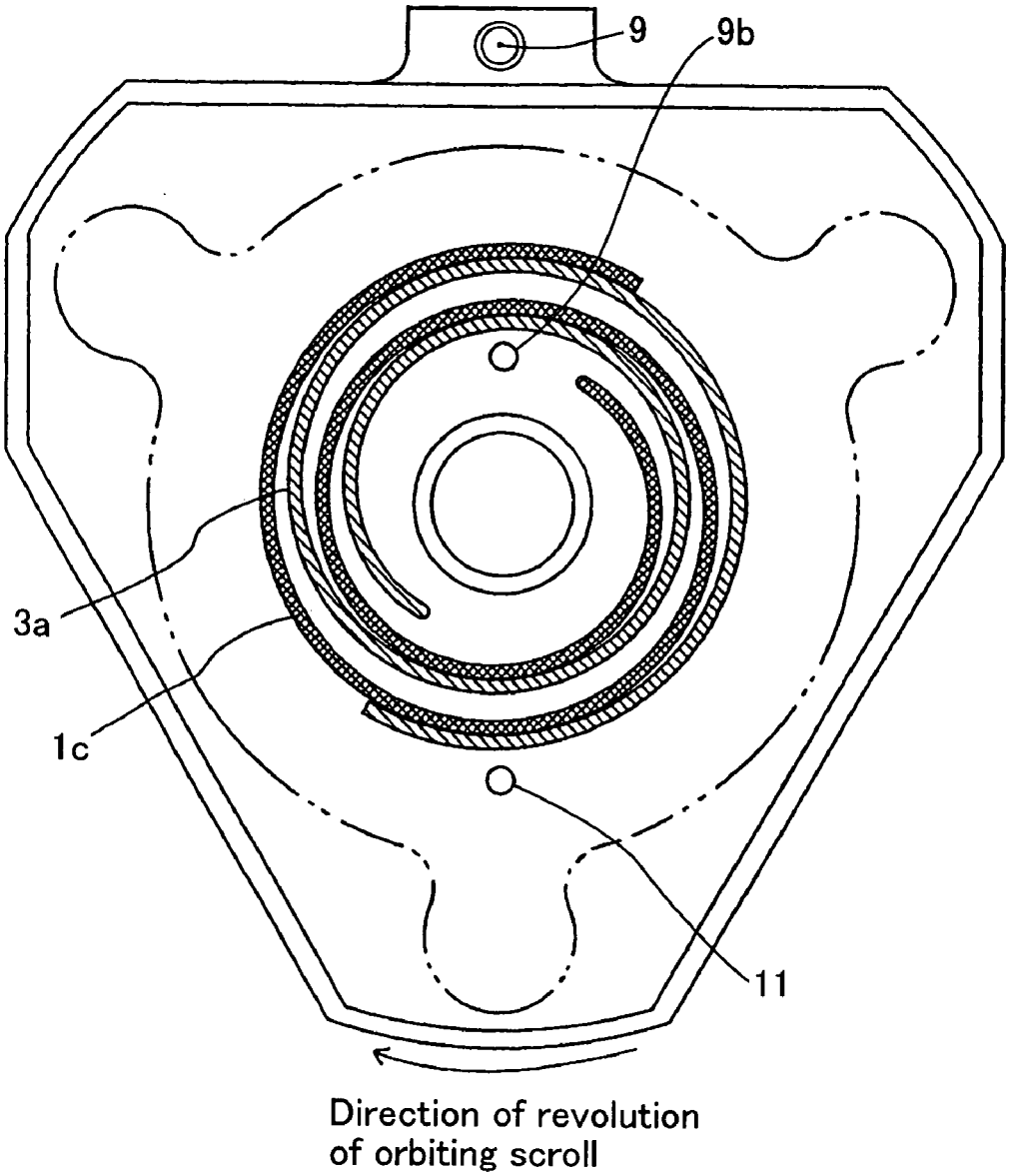
FIG. 3 is a vertical sectional view taken along the line III–III in FIG. 1.

In FIG. 3, an inlet 9 for the compressing section is formed in the outermost portion of the rear stationary scroll 3 and communicates with an opening 9*b* via a radial path 9*a* of the rear stationary scroll end plate 3*b*. A pipe 9*a* is connected to the opening 9*b*. Fluid which comes towards the center of the compressing section from the opening 9*b* is expanded outward with revolution of the orbiting scroll; introduced to the electric motor through an inner outlet 11 of the rear stationary scroll end plate; and discharged to the outside from an outlet 27 after cooling armatures etc.

A sucking port and a discharge port of the compressing section and the inlet of the expanding section open on the front side of the scroll fluid machine thereby omitting the necessity of protruding conduits from the outer circumference of the scroll fluid machine 10 to avoid increase in the external diameter of the scroll fluid machine 10. It is advantageous when the scroll fluid machine is installed in automobiles that are strictly limited in space.

In FIGS. 1 to 3, the sucking port, discharge port and outlet are circular, but may be any shapes for obtaining a desired sectional area. The sucking port, discharge port and outlet are all on the front side of the stationary scroll end plate thereby decreasing the external diameter of the scroll fluid machine and arranging piping structure orderly to provide good appearance. If required, a cooling fin may be provided on the stationary scroll.

Figure 4:
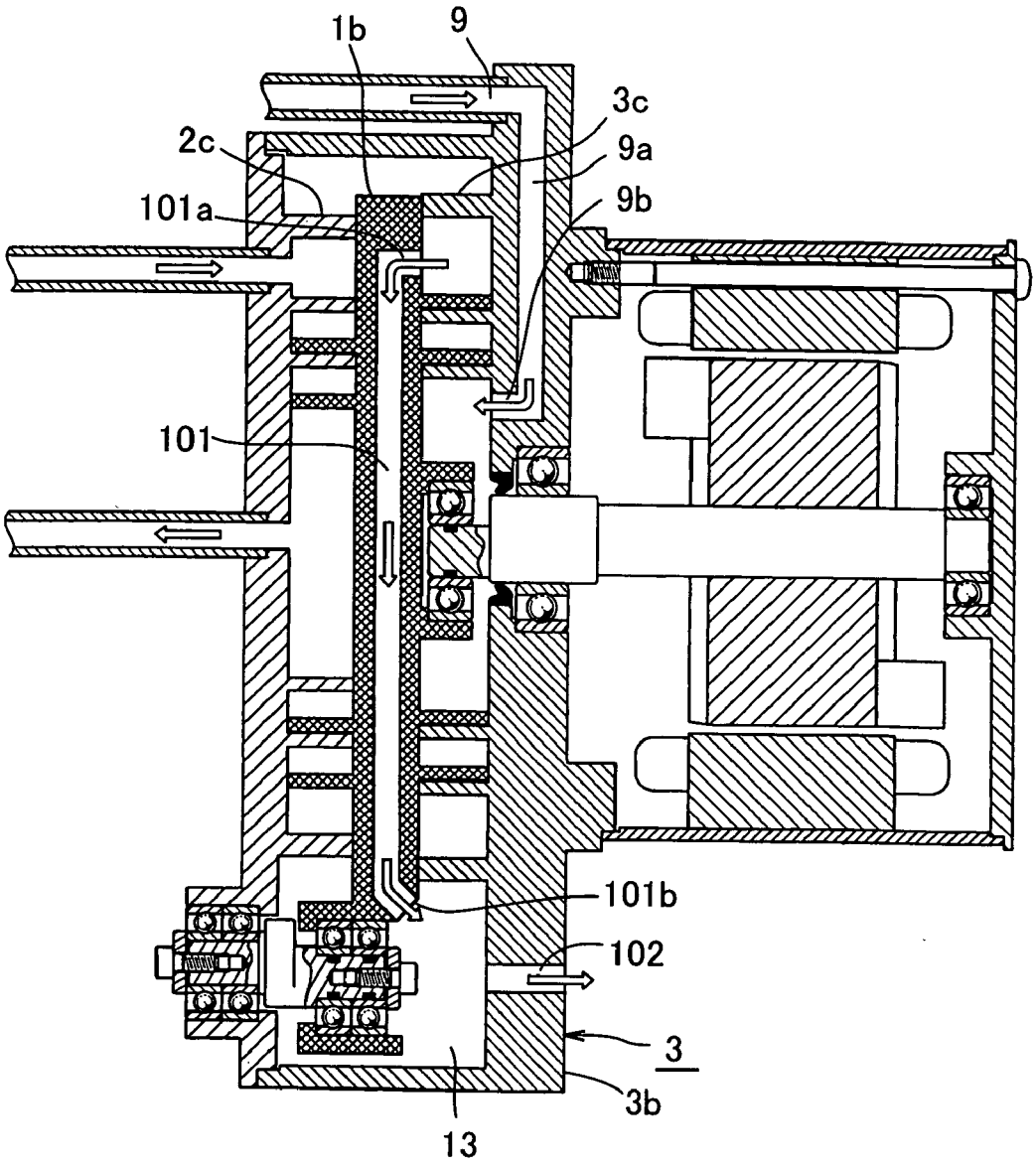
FIG. 4 is a vertical sectional view of the second embodiment of a scroll fluid machine according to the present invention.

FIG. 4 is a vertical sectional view of the second embodiment of the present invention. The same numerals are allotted to the same members as those in FIG. 1 or omitted.

In this embodiment, an annular partition wall 3*c* is provided on a stationary end plate 3*b* of a rear stationary scroll 3, so that a compressing section is partitioned from outer circumferential spaces of an orbiting scroll. In an orbiting scroll end plate 1*b*, there is formed a cooling path 101 which has a feeding port 101*a* between an outermost scroll wrap and the annular partition wall 3*c*, and a discharge port 101*b* outside the partition wall 3*c*.

Fluid which flows from an inlet 9*b* of a rear stationary end plate is expanded with revolution of the orbiting scroll; introduced into the cooling path 101 from the feeding port 101*a* to cool the orbiting scroll; forwarded from the discharge port 101*b* into an outer circumferential space 13 partitioned by the partition wall 2*c* of the front stationary scroll and the partition wall 3*c* of the rear stationary scroll end plate 3*b*; and discharged to the outside from the outlet 102 of the rear stationary scroll end plate 3*b*.

The outlet may be formed on the front stationary scroll end plate.

The shape and number of the cooling path 101 may be determined to cool the orbiting scroll uniformly. For example, the cooling path may be a disc-like space as shown.

Figure 5:
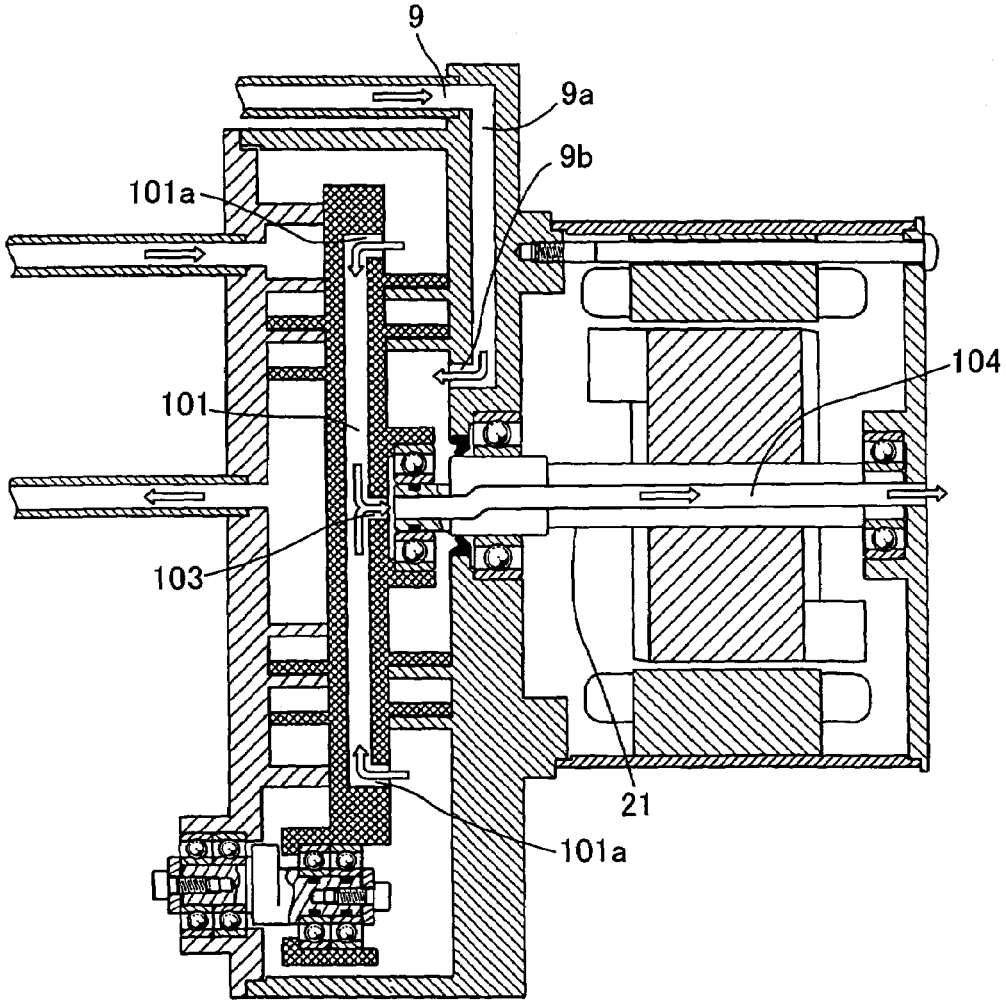
FIG. 5 is a vertical sectional view of the third embodiment of a scroll fluid machine according to the present invention.

FIG. 5 is a vertical sectional view of the third embodiment of the present invention. The same numerals are allotted to the same members as those in FIG. 1 or omitted.

In this embodiment, there is no annular partition wall on a rear stationary scroll in FIG. 4. Fluid expanded in an expanding section flows into a cooling path 101 through feeding ports 101*a*, 101*a*, passes through a through-hole 104 of a driving shaft 21 of an electric motor from a central inlet 103 to cool the inner side of a bearing and is discharged to the outside.

The shape and number of the cooling path 101 may be determined to cool the orbiting scroll uniformly. For example, the cooling path may be a disc-like shape as shown.

Figure 6:
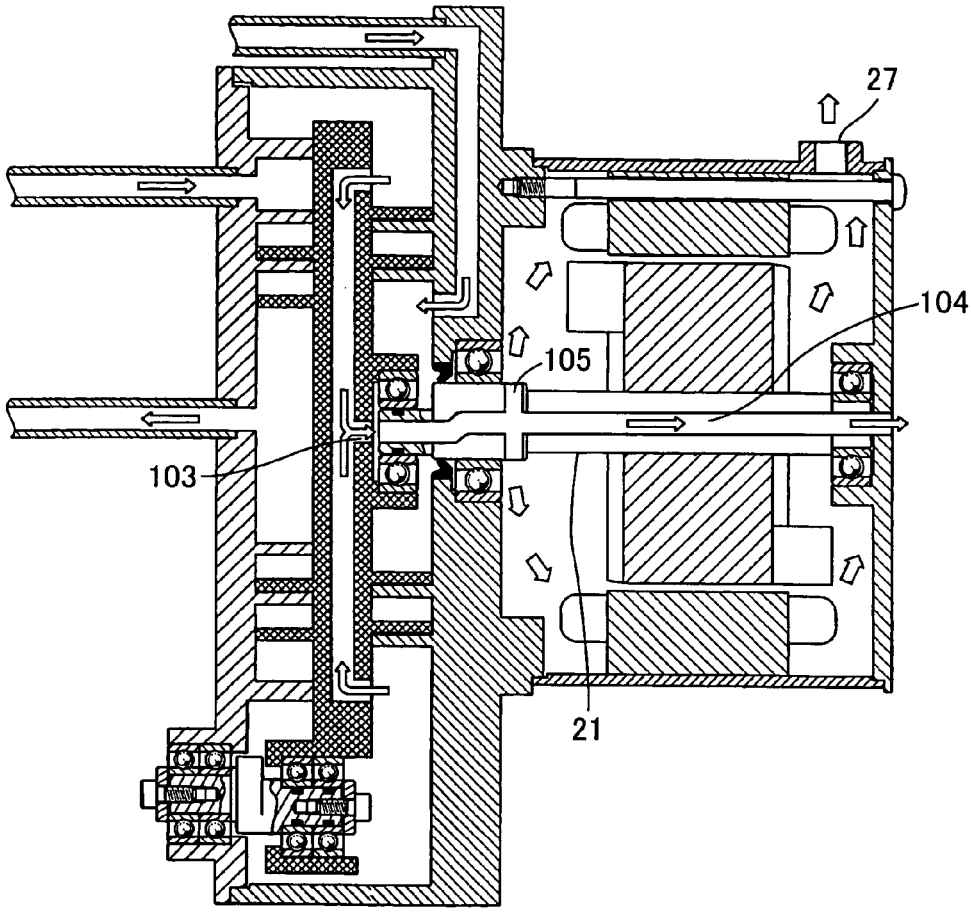
FIG. 6 is a vertical sectional view of the fourth embodiment of a scroll fluid machine according to the present invention.

FIG. 6 is a vertical sectional view of the fourth embodiment of the present invention. The same numerals are allotted to the same members as those in FIG. 1, or omitted.

In this embodiment, a through-hole 104 of the driving shaft 21 of an electric motor communicates with the inside of the electric motor via a bore 105, so that at least part of fluid in the through-hole 104 flows into the inside of the electric motor to cool armatures and is discharged to the outside from an outlet 27.

The shape and number of the cooling path are determined to cool an orbiting scroll uniformly. For example, the cooling path may be a disc-like shape as shown.

Figure 7:
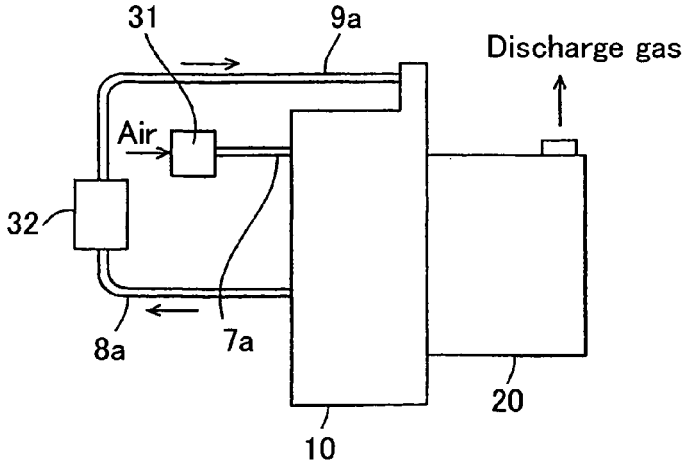
FIG. 7 is a flowchart of a piping structure of a fuel cell in which the scroll fluid machine in FIG. 1 is applied.

FIG. 7 schematically shows a flowchart of a piping structure when the scroll fluid machine in FIG. 1 is used as a fuel cell. Air cleaned by an air filter 31 is sucked into a scroll fluid machine 10 via a pipe 7*a*, compressed in a compressing section of the scroll fluid machine 10 and pressedly forwarded to an anode of a fuel cell 32 via a pipe 8*a*. On the anode of the fuel cell, oxygen in compressed air is allowed to react with hydrogen ions moved in an electrolyte layer from a cathode to form $H_2O$. A gas discharged from the fuel cell 32 is a compressed gas which contains nitrogen as main component and water.

The reaction of hydrogen with oxygen to produce $H_2O$ is an exothermic reaction. Hence, the gas discharged from the fuel cell has higher temperature than supplied air, but has lower pressure by resistance of flow. Supplied air and discharged gas are cooled on the way of the pipe if necessary.

The water content in the discharged gas is removed by a dehumidifier (not shown) and forwarded into the outer circumferential space of the rear fixed stationary end plate in the scroll fluid machine 10 via a pipe 9*a*. The compressed gas from which the water content is removed flows into the center of the expanding section through the path in the rear stationary scroll end plate. As shown in FIG. 1, the gas is adiabatically expanded in the expanding section, so that temperature falls. The gas is introduced into the electric motor and discharged from the electric motor to the outside after cooling.

The compressed gas made expansion to apply torque to the orbiting scroll when it is adiabatically expanded in the expanding section, and the torque acts to assist compression in the compressing section, so that compressing work in the compressing section is partially retrieved. The scroll fluid machine in the embodiments in FIGS. 4 to 6 may be applied to a fuel cell as well.

Figure 8:
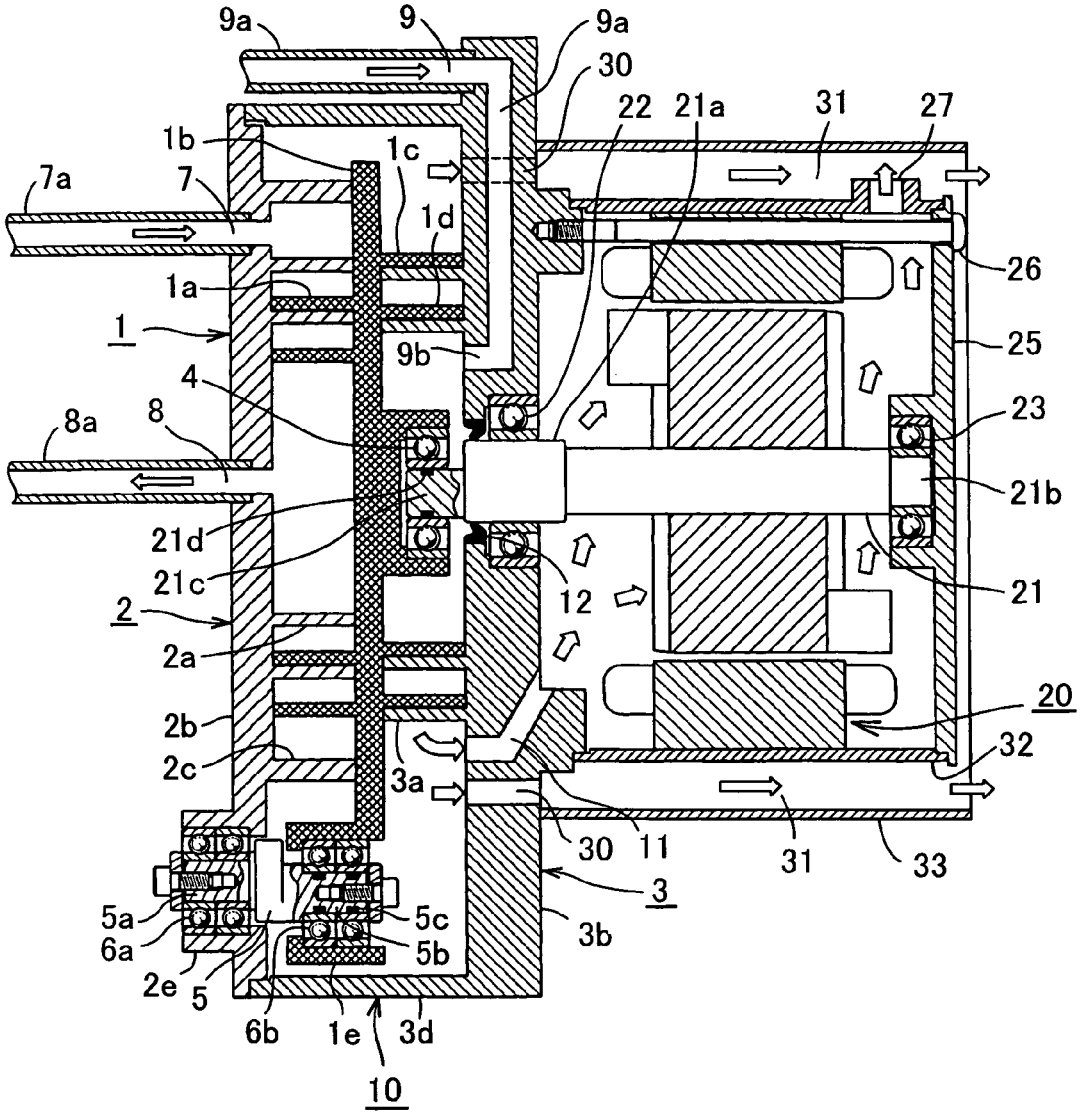
FIG. 8 is a vertical sectional view of the fifth embodiment of a scroll fluid machine according to the present invention.

FIG. 8 shows the fifth embodiment of the present invention. An expanding section communicates via an outer outlet 30 with an circumferential path 31 formed between an inner circumferential wall 32 and an outer circumferential wall 33 around an electric motor 20. The electric motor 20 is cooled by fluid that flows through the circumferential path 31. Noise leaks through a discharge bore 27 from the electric motor, but the outer circumferential wall 33 prevent noise from leaking to outside.

Figure 9:
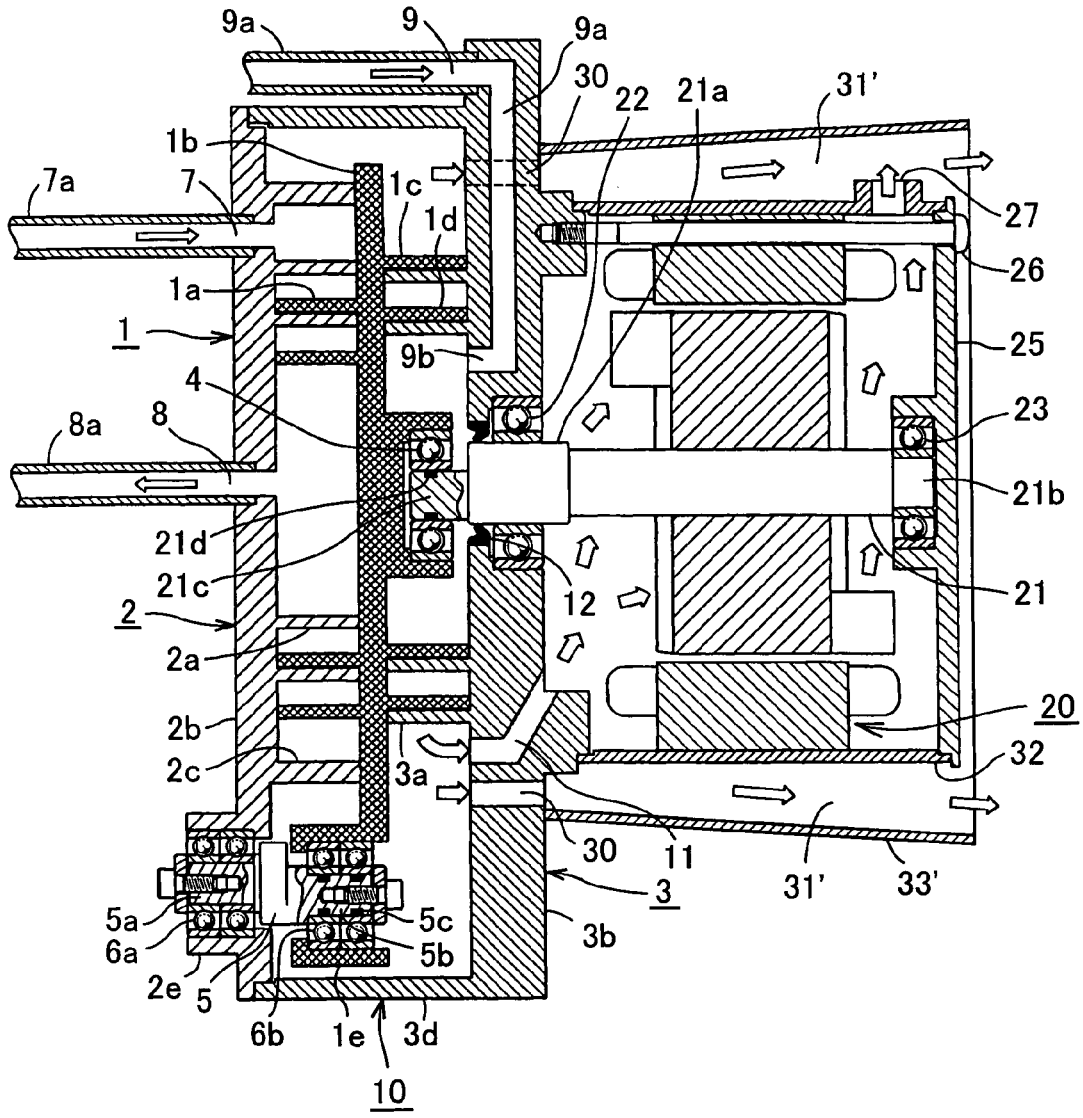
FIG. 9 is a vertical sectional view of the sixth embodiment of a scroll fluid machine according to the present invention.

FIG. 9 shows the sixth embodiment of the present invention. An outer circumferential wall 33' gradually increases in external diameter rearward, so that a sectional area of a circumferential path 31' gradually increases. Fluid from the expanding section through the outer outlet 30 is depressurized and cooled. Fluid through the circumferential path 31' effectively cools an electric motor 20 and its parts.

Figure 10:
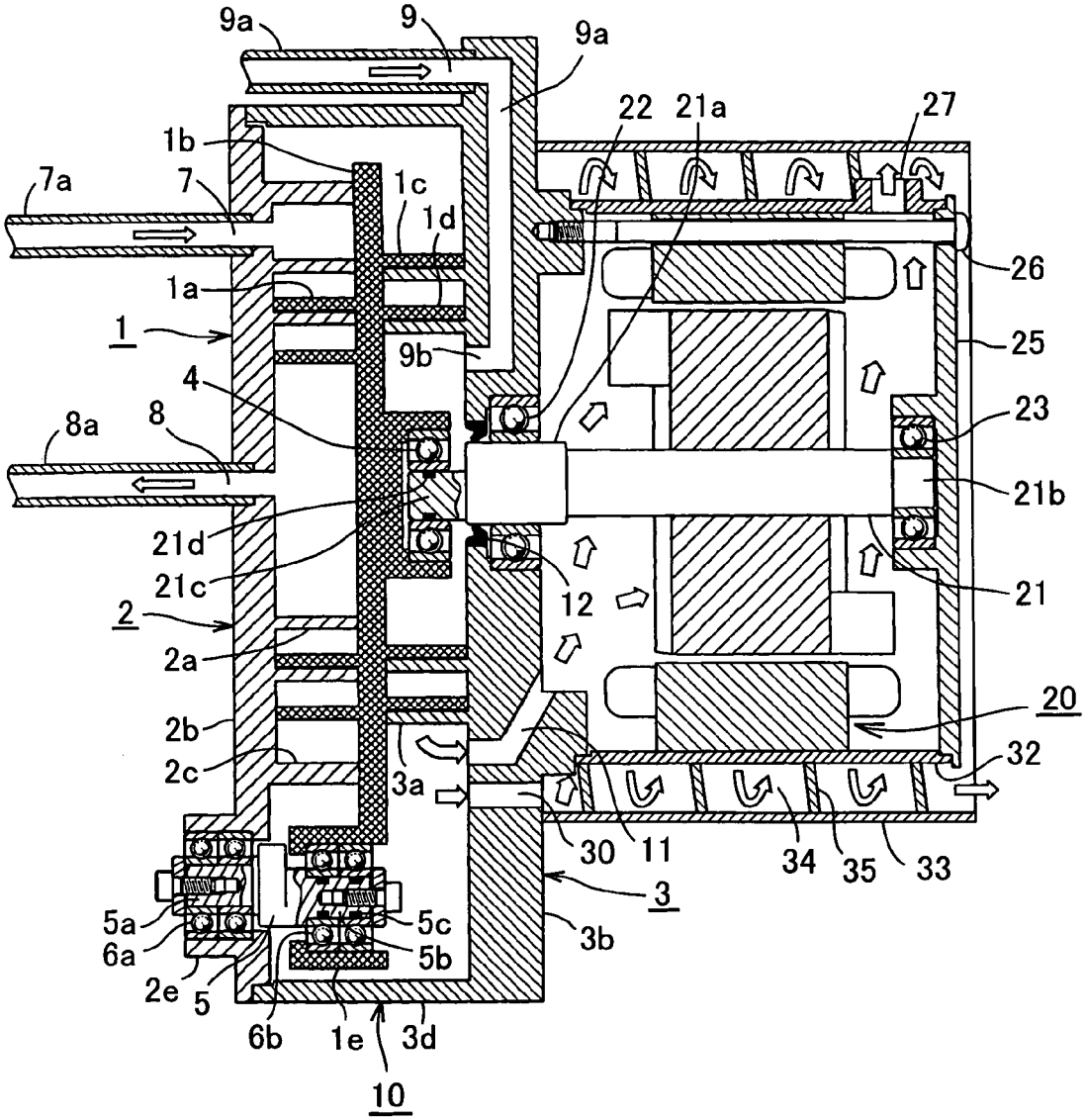
FIG. 10 is a vertical sectional view of the seventh embodiment of a scroll fluid machine according to the present invention.

FIG. 10 shows the seventh embodiment of the present invention. Fluid flows from an expanding section into a spiral path 34 formed by a spiral wall 35 between an inner circumferential wall 32 and an outer circumferential wall 33, through an outer outlet 30. A pitch of the spiral wall 35 gradually increases rearward, and fluid from the expanding section is depressurized and cooled. Fluid cools an electric motor 20 and its parts. Noise of the electric motor 20 is prevented by the outer circumferential wall 33.

The foregoing merely relates to embodiments of the invention. Various changes and modifications may be made by a person skilled in the art without departing from the scope of claims wherein:

What is claimed is:

1. A scroll fluid machine comprising:

a driving shaft having an eccentric portion at one end:

an orbiting scroll comprising an orbiting end plate that has front and rear scroll wraps, said orbiting end plate being fitted on the eccentric portion of the driving shaft;

a front stationary scroll comprising a front stationary end plate that has a front stationary wrap;

a rear stationary scroll comprising a rear stationary end plate that has a rear stationary wrap; and an electric motor for driving the driving shaft behind the rear stationary end plate, the orbiting scroll being driven by the driving shaft and revolved with respect to the front and rear stationary scrolls while the front and rear orbiting scroll wraps are engaged with the front and rear stationary scroll wraps respectively to create front compressing and rear expanding sections, fluid expanded and cooled in the rear expanding section flowing from the rear expanding section to the electric motor through an inner outlet of the rear stationary end plate to cool the electric motor.

2. A scroll fluid machine as claimed in claim 1 wherein an inlet for introducing fluid into the expanding section opens towards a front side of the fluid scroll machine.

3. A scroll fluid machine as claimed in claim 1 wherein a cooling path is longitudinally formed through the orbiting end plate, the fluid from the expanding section cooling the orbiting end plate and being discharged.

4. A scroll fluid machine as claimed in claim 3 wherein the driving shaft has an axial through-hole communicating with the cooling path of the orbiting end plate, the fluid from the expanding section flowing via the cooling path of the orbiting end plate into the axial bore of the driving shaft to cool the driving shaft.

5. A scroll fluid machine as claimed in claim 4 wherein the fluid that passes through the axial through-hole of the driving shaft is partially discharged to the inside of the electric motor to cool it.

6. A scroll fluid machine as claimed in claim 1 wherein the expanding section communicates via an outer outlet of the rear stationary end plate with a circumferential path around the electric motor between an inner circumferential wall and an outer circumferential wall.

7. A scroll fluid machine as claimed in claim 6 wherein an external diameter of the outer circumferential wall gradually increases rearward.

8. A scroll fluid machine as claimed in claim 6 wherein the circumferential path comprises, a spiral path defined by a spiral wall between the inner circumferential wall and the outer circumferential wall.

9. A scroll fluid machine as claimed in claim 8 wherein a pitch of the spiral wall gradually increases rearward.

* * * * *